US006325000B1

(12) United States Patent
Furuta

(10) Patent No.: US 6,325,000 B1
(45) Date of Patent: Dec. 4, 2001

(54) WASTE INCINERATION MACHINE

(75) Inventor: Satoshi Furuta, Aichi-ken (JP)

(73) Assignee: Meito Corporation, Aichi-ken (JP)

( * ) Notice: Subject to any disclaimer, the term of this patent is extended or adjusted under 35 U.S.C. 154(b) by 0 days.

(21) Appl. No.: 09/699,460

(22) Filed: Oct. 31, 2000

(30) Foreign Application Priority Data

Nov. 16, 1999 (JP) ..... 11-326076

(51) Int. Cl.[7] ..... F23G 5/12; F23J 15/00; F23M 9/00

(52) U.S. Cl. ..... 110/229; 110/230; 110/240; 110/241; 110/259; 110/203; 110/309; 110/310; 110/323

(58) Field of Search ..... 110/218, 219, 110/229, 230, 231, 235, 236, 240, 241, 259, 203, 207, 295, 309, 310, 322, 323, 336, 337, 342, 121

(56) References Cited

U.S. PATENT DOCUMENTS

| | | | | |
|---|---|---|---|---|
| 2,199,139 | * | 4/1940 | Murphy | 122/225 |
| 5,029,534 | * | 7/1991 | Childs | 110/341 |
| 5,184,539 | * | 2/1993 | Oiwa | 99/408 |
| 5,363,777 | * | 11/1994 | Yoshimoto et al. | 110/214 |
| 5,632,197 | * | 5/1997 | Lubawy et al. | 99/403 |
| 5,727,482 | * | 3/1998 | Young | 110/244 |
| 6,073,541 | * | 6/2000 | Oiwa | 99/330 |

FOREIGN PATENT DOCUMENTS

| | | |
|---|---|---|
| 7225015 | 8/1995 | (JP) . |
| 7324719 | 12/1995 | (JP) . |

* cited by examiner

*Primary Examiner*—Henry Bennett
*Assistant Examiner*—K. B. Rinehart
(74) *Attorney, Agent, or Firm*—Arent Fox Kintner Plotkin & Kahn, PLLC

(57) ABSTRACT

A waste incineration machine capable of rendering a waste gas occurring during the combustion of waste smokeless and odorless. A heat insulating wall to which a first far infrared ray radiator is fixed is provided so as to surround a combustion furnace and a combustion chamber, and a heat exchanger so as to surround the heat insulating wall. An inner flue is formed between the heat insulating wall and combustion furnace, and an outer flue serving as a waste gas convection chamber between the heat insulating wall and heat exchanger. An upper part of a communication portion between the inner and outer flues is covered with a heat insulating member constituting a second far infrared ray radiator so as to subject the waste gas to secondary heating using far infrared rays, and thereby to render the waste gas smokeless and odorless. Preferably, the heat insulating wall is formed into a substantially cylindrical shape, and the heat exchanger into a rectangular box-shape open at the top and the bottom, whereby the volume of the outer flue is increased to thereby lengthen the time for circulating the waste gas by convection.

4 Claims, 4 Drawing Sheets

WASTE INCINERATION MACHINE

BACKGROUND OF THE INVENTION

1. Field of the Invention

This invention relates to a waste incineration machine for burning mainly garbage, and more particularly to a small-sized waste incineration machine capable of removing smoke and odor occurring during the combustion of waste.

2. Description of the Related Art

The techniques for secondarily burning a waste gas, which occurs when waste is burnt, by an after-burner provided so as to render the waste gas smokeless and odorless have heretofore been known. These techniques include as shown in, for example, Japanese Patent Laid-Open No. 225,015/1995, the techniques for providing a secondary combustion burner in a secondary combustion chamber connected to a primary combustion chamber, and completely burning a waste gas, which occurs in the primary combustion chamber, by the secondary combustion burner so as to render the waste gas smokeless.

The techniques for providing a far infrared ray radiant material in an incineration machine, and secondarily burning a waste gas with far infrared rays to render the waste gas smokeless, are also known. Such techniques include techniques disclosed in, for example, Japanese Patent Laid-Open No. 324,719/1995, in which a net cylinder is provided in a combustion chamber in an incinerator with a space between the net cylinder and an inner wall surface of the combustion chamber filled with a far infrared ray radiant material. In this incinerator, waste is burnt in the net cylinder, and a waste gas occurring therein flows up as it passes through a layer of the far infrared ray radiant material, whereby the waste gas is completely burnt and discharged to the outside.

However, since the waste incineration machine disclosed in the former publication requires a secondary combustion chamber and a secondary combustion burner, not only the dimensions of a machine body but also the combustion cost increases. Therefore, this waste incineration machine is unsuitable to be used as a small-sized waste incineration machine.

Since the waste incineration machine disclosed in the latter publication is provided with a chimney just on an upper portion of the combustion chamber, a waste gas passes upward at a high speed. Consequently, the waste gas is discharged from the chimney to the outside, and the waste gas goes outside without having received the sufficient radiation of the far infrared rays. Thus, there is the possibility that the waste gas is not completely burnt and cannot be rendered smokeless.

SUMMARY OF THE INVENTION

The present invention has been made in view of the above-mentioned circumstances, and provides a waste incineration machine which solves these problems, and which is capable of rendering a waste gas discharged during the combustion of waste smokeless and odorless without providing an after-burner.

The present invention also provides a waste incineration machine capable of obtaining hot water by utilizing the heat of a waste gas, reducing the temperature of a waste gas and preventing an increase in an ambient temperature of the incineration machine.

According to an aspect of the present invention, the waste incineration machine includes a combustion furnace, a combustion chamber provided under the combustion furnace, a first far infrared ray radiator provided so as to surround the combustion furnace and combustion chamber, a heat exchanger provided so as to surround the first far infrared ray radiator, an inner flue formed between the first far infrared ray radiator and combustion furnace, an outer flue formed between the first far infrared ray radiator and heat exchanger and communicating with the inner flue, a second far infrared ray radiator provided above a communication portion between the inner and outer flues, and waste gas discharge ports provided in the combustion furnace so as to face the communication portion or inner flue.

According to another aspect of the present invention, the first far infrared ray radiator of the waste incineration machine is formed into a substantially cylindrical shape, the heat exchanger being formed into a rectangular box-shape open at the top and the bottom.

According to still another aspect of the present invention, the outer flue of the waste incineration machine is provided at a lower portion thereof with ventilating ports, in which dampers are provided.

According to a further aspect of the present invention, the combustion furnace of the waste incineration machine is provided with an air blowout port, to which a blower is connected via a blast pipe, an openable shutoff member being provided in the blast pipe so that the air does not enter the air blowout port.

BRIEF DESCRIPTION OF THE DRAWINGS

A preferred embodiment of the present invention will be described in detail on the basis of the following figures, wherein.

DESCRIPTION OF THE PREFERRED EMBODIMENT

A mode of embodiment of the present invention will now be described with reference to the drawings.

Figure 1:
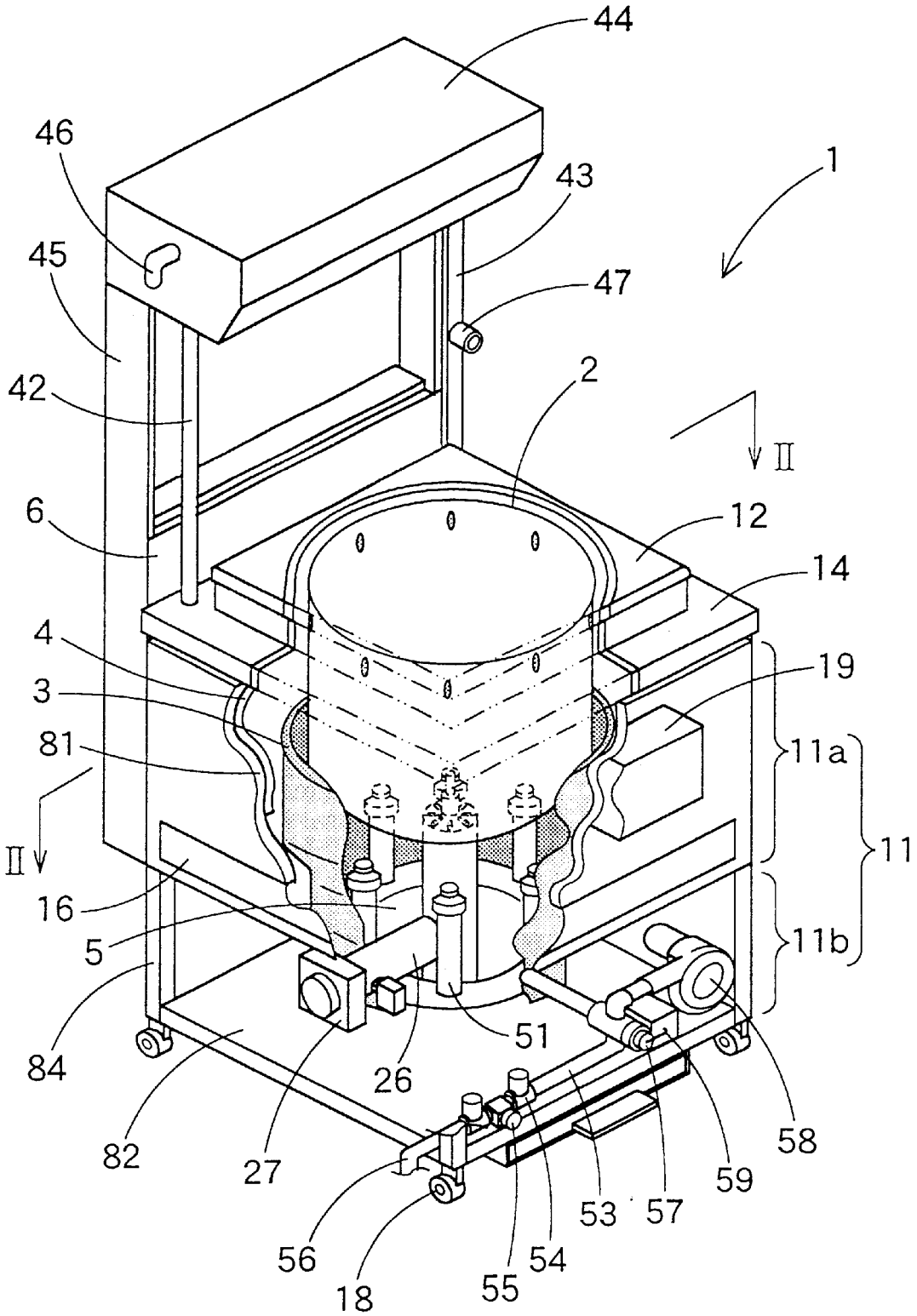
FIG. 1 is a partially cutaway view in perspective of the waste incineration machine.
Figure 2:
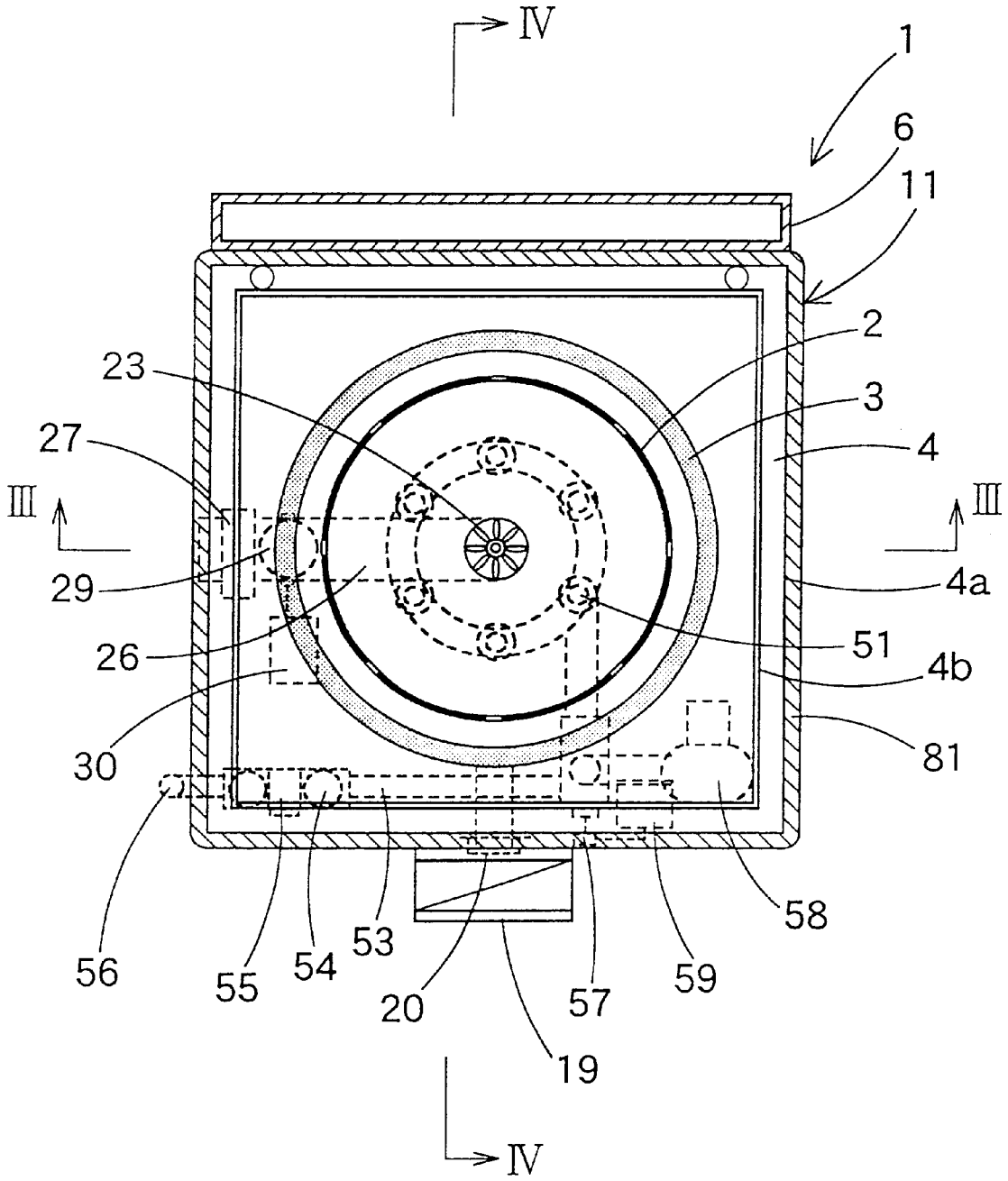
FIG. 2 is a horizontal sectional view of a portion II—II of FIG. 1.
Figure 3:
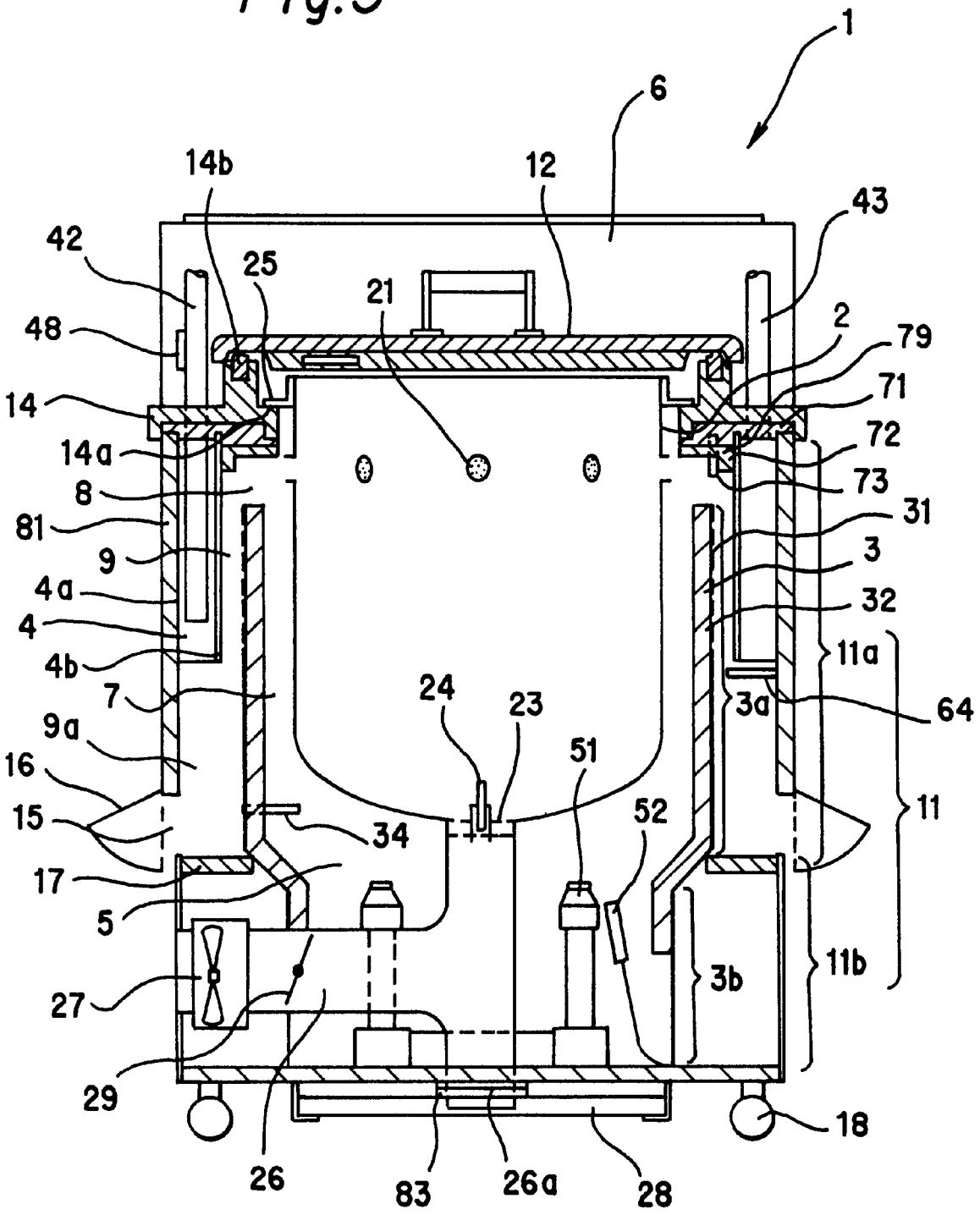
FIG. 3 is a longitudinal sectional view of a portion III—III of FIG. 2.

As shown in FIGS. 1–3, a waste incineration machine 1 is formed by providing a combustion furnace 2 installed in an inner portion of a casing 11, a combustion chamber 5 formed under the combustion furnace 2, a heat insulating wall 3 surrounding the combustion furnace 2 and combustion chamber 5 with a predetermined space left therebetween, a heat exchanger 4 surrounding the heat insulating wall 3 with a predetermined space left therebetween, and a blower 27 adapted to blow the air into the combustion furnace 2. The waste incineration machine 1 is further provided with an openable cover 12 enclosing an upper surface of the casing 11, a covering member 14 supporting the openable cover 12, an exhaust cylinder 6 disposed adjacently to a rear surface of the casing 11, and a tank 44 disposed above the exhaust cylinder 6 and joined to the heat exchanger 4.

Figure 4:
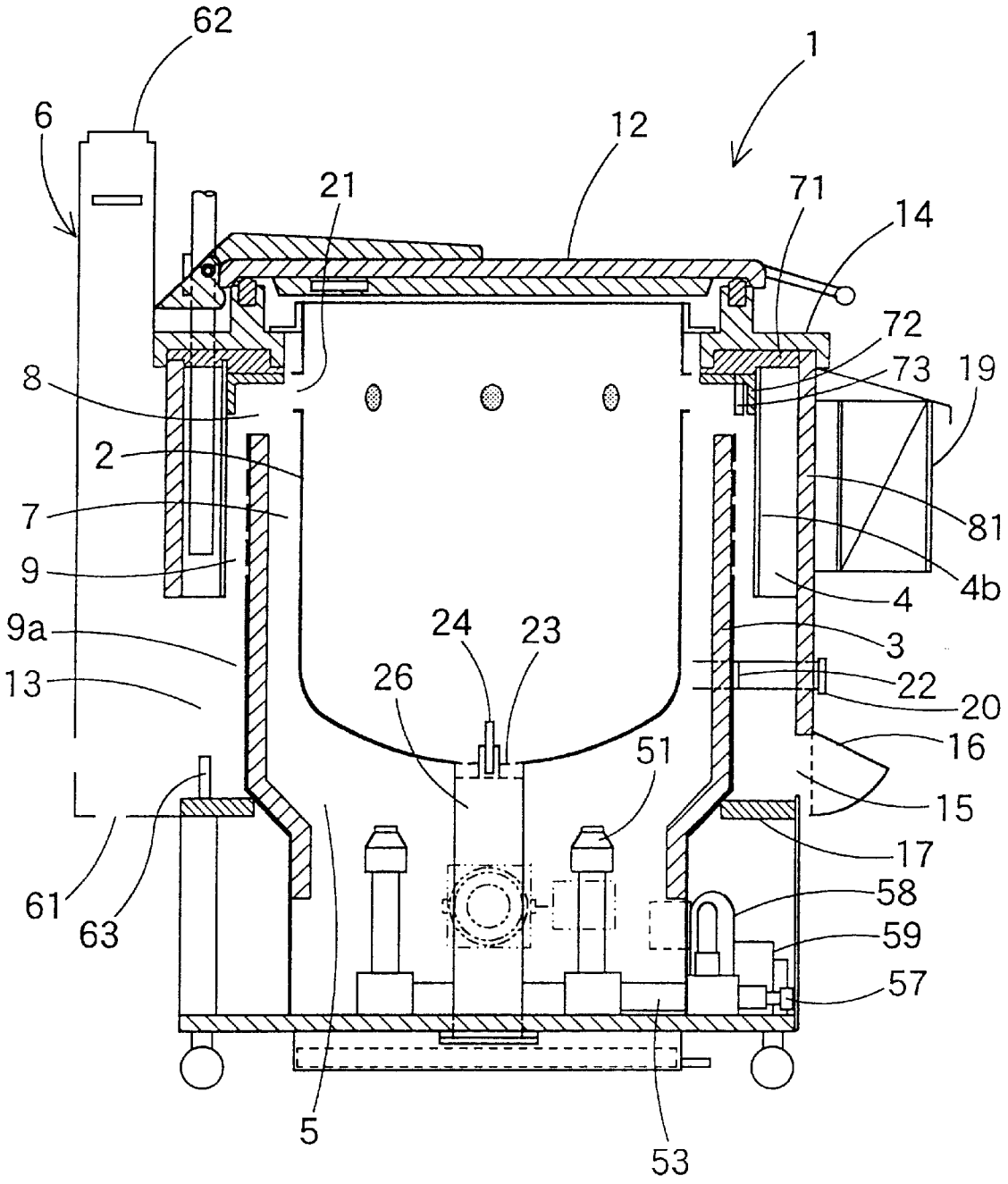
FIG. 4 is a longitudinal sectional view of a portion IV—IV of FIG. 2.

The casing 11 is made of stainless steel or the like and includes, as shown in FIG. 1, an upper portion 11*a* surrounding the combustion furnace 2, and a lower portion 11*b* in which main burners 51 and blower 26 are provided. The upper portion 11*a* is formed into a rectangular box-shape open at the top and the bottom, while the lower portion 11*b* is provided with leg members 84 at four corner portions of a base plate 82 which constitutes a bottom surface of the lower portion 11*b,* and which has a rectangular shape in plan, in such a manner that the leg members 84 extend upward to support the upper portion 11*a*. The front, rear and both side sections of the lower portion 11*b* are opened for the purpose of letting pressure waves escape therefrom when a backfire occurs. The base plate 82 is provided with castors 18 on four corner portions of a lower surface thereof. Heat insulating plates 81 formed of heat insulating members, such as asbestos boards, are fixed on an inner surface of the upper portion 11*a*. As shown in FIGS. 3 and 4, the heat insulating plates 81 on the front and both sides of the upper portion 11*a* are provided at lower parts thereof with rectangular ventilating ports 15. The ventilating ports 15 are provided with rectangular plate type dampers 16 punched with an aperture ratio of about 60%, and fixed pivotably at their respective upper parts to the portions of the casing 11 which correspond to upper parts of the ventilating ports 15, whereby the dampers 16 are set so as to be able to be opened and closed. As shown in FIG. 4, the upper portion 11*a* is provided on its front surface (right side in the drawing) with a control panel 19 and a peephole 20 for use in ascertaining the condition of the interior of the combustion chamber 5.

The combustion furnace 2 is formed into a bottomed cylindrical body as shown in FIG. 3 out of a heat resisting material, such as titanium, and installed detachably in a central part of the interior of the upper portion 11*a* of the casing. The combustion furnace 2 is provided at an upper portion thereof with plural waste gas discharge ports 21 spaced in the circumferential direction thereof, in such a manner that the discharge ports 21 face a communication portion 8 formed between inner and outer flues 7, 9 which will be described later. An outwardly projecting flange 25 is fixed to the portion of the combustion furnace 2 which is in the vicinity of an upper end thereof over the whole circumference thereof. The flange 25 is supported on an inner circumferential portion 14*a* of the covering member 14 provided on an upper surface of the casing 11, whereby the combustion furnace 2 is housed in the casing 11. The combustion furnace 2 is provided at a central part of a bottom portion thereof with an air blowout port 23 from which the air sent from the blower 27 is blown out into the interior of the combustion furnace 2, and a proportional thermostat 24 for detecting a temperature of the interior of the combustion furnace 2 is inserted into a central portion of the air blowout port 23 so that a free end portion of the thermostat 24 projects into the interior of the combustion furnace 2. An upper opening of the combustion furnace 2 is closed with the openable cover 12 made of a casting or the like.

As shown in FIGS. 3 and 4, the combustion chamber 5 is formed under the combustion furnace 2 inside the heat insulating wall 3, and substantially shut off from the outside by the heat insulating wall 3. As shown in FIG. 1, the combustion chamber 5 is provided with the main burners 51 connected to a gas supply pipe 56 via a conduit 53, a valve 54 and a gas governor burner 55, and a pilot burner 52 (refer to FIG. 3). At an intermediate portion of the conduit 53, a mixing valve 57 connected to the blower 58 for mixing the air and a gas with each other is provided. The mixing valve 57 is controlled by a motor 59.

The casing 11 is provided in the lower portion thereof with the blower 27 as shown in FIGS. 1 and 3, and one end portion of a blast pipe 26 is connected to the blower 27. The other end portion of the blast pipe 26 extends upward and downward so as to have a substantially T-shaped form, and the upwardly extending part is joined to the air blowout port 23 with the downwardly extending part projecting out to a position below a lower wall of the casing 11, a lower end portion of this downwardly extending part being provided with an ash falling port 26*a*. The blast pipe 26 is provided in the interior of the portion thereof which is on the side of the blower 27 with a substantially circular blast damper 29 as shown in FIGS. 2 and 3, as a member for regulating a blast rate and shutting off the air. The blast damper 29 is connected to a damper motor 30, which is provided on one side of the blast pipe 26, whereby a degree of opening of the blast damper 29 is regulated. As shown in FIG. 3, a shutter 83 having a substantially rectangular shape in plan is provided openably under the ash falling port 26*a,* as a shutoff member for opening and closing the ash falling port 26*a* and shutting off the air. A lower ash receiving dish 28 is provided drawably under the shutter 83.

The heat insulating wall 3 is formed by fixing a far infrared ray radiator 32, for example, ceramic fiber made of a zirconia ceramic material $ZrO_2$, to an inner surface of a punched cage 31, into a shape of a substantially stepped cylinder having an upper expanded portion 3*a* surrounding the combustion furnace 2, and a lower narrowed portion 3*b* in which the main burners 51 are provided. The far infrared radiator 32 is fixed to the whole of the inner surface of the punched cage 31 except an inner surface of a lower part of the narrowed portion 3*b*. The part (corresponding to a substantially upper half part of the expanded portion 3*a* of FIG. 3) of the punched cage 31 which is opposed to the heat exchanger 4 is punched with an aperture ratio of about 60% so that far infrared rays are radiated outward easily. A lower end of the narrowed portion 3*b* is supported on the base plate 82 at a bottom portion of the casing 11.

Between the heat insulating wall 3 and combustion furnace 2, the inner flue 7 in which a combustion gas from the combustion chamber 5 flows up is formed. Into the portion of the heat insulating wall 3 which faces the combustion chamber 5, a combustion chamber thermostat 34 for use in detecting a temperature in the combustion chamber 5 is inserted so that a free end of the thermostat 34 projects into the combustion chamber 5. As shown in FIG. 4, the part of a lower portion of a front surface (right side in the drawing) of the heat insulating wall 3 which is opposed to the peephole 20 of the casing 11 is provided with a peephole 22 for use in ascertaining the condition of the interior of the combustion chamber 5.

The heat exchanger 4 is adapted so as to reduce the temperature of a waste gas, which is discharged from the waste gas discharge ports 21 of the combustion furnace 2, and to obtain hot water by subjecting the heat of the waste gas to heat exchange. The heat exchanger 4 is formed into a rectangular box-shape open at the top and the bottom as shown in FIGS. 2 and 3, and disposed so that an outer surface 4*a* contacts the heat insulating plate 81 fixed to an inner surface of the upper portion 11*a* of the casing. As shown in. FIG. 3, a space between outer and inner surfaces 4*a,* 4*b* of the heat exchanger 4 is closed at upper and lower portions thereof and thereby made hollow. In one side portion of this hollow, a lower end portion of a hot water falling pipe 42 for supplying water from the tank 44 to the heat exchanger 4 is inserted, while, to the other side portion of the hollow, a lower end portion of a hot water rising pipe 43 for circulating hot water from the heat exchanger 4 to the tank 44 is connected.

As shown in FIGS. 3 and 4, the outer flue 9 serving as a convection chamber for circulating a waste gas, which is discharged from the combustion furnace 2 by convection, is formed between the heat exchanger 4 and heat insulating wall 3. An upper portion of the outer flue 9 communicates with that of the inner flue 7 via the communication portion 8 which will be described later. A lower portion 9*a* of the outer flue 9 is surrounded, as shown in FIG. 3, by the portion of the heat insulating plate 81 which is below the heat exchanger 4, an outer surface of the heat insulating wall 3 and an inner ash receiving dish 17 provided under the ventilating ports 15, and communicates as shown in FIG. 4, with the exhaust cylinder 6 via an exhaust cylinder connecting port 13 provided on a rear side of a lower part of the upper portion 11*a*. The inner ash receiving dish 17 is provided so as to close a space between an inner surface of the casing 11 and an outer surface of the heat insulating wall 3. As shown in FIG. 3, an exhaust thermostat 64 for detecting a temperature in the outer flue 9 is inserted in the lower portion 9*a* of the outer flue 9 so as to project at a free end portion thereof into the interior of the same lower portion 9*a*.

The covering member 14 formed of a casting or the like is put on the upper surface of the casing 11 so as to close a space between the casing 11 and combustion furnace 2 as shown in FIG. 3. The covering member 14 has an inner circumferential portion 14*a* supporting the flange 25 of the combustion furnace 2, and an upwardly projecting portion 14*b* closely contacting the openable cover 12.

As shown in FIGS. 3 and 4, a heat insulating member 72 a second far infrared ray radiator formed of ceramic fiber or the like, is provided under the covering member 14 so as to enclose a portion above the heat insulating wall 3 via a filler 71 formed of glass fiber or the like. In this mode of embodiment, an outer circumference of the heat insulating member 72 is formed into a rectangular shape in plan so as to contact the inner surface 4*b* of the heat exchanger 4, while an inner circumference of the heat insulating member 72 is formed into a circular shape in plan so as to surround the combustion furnace 2, the portion of the heat insulating member 72 which contacts the inner surface 4*b* of the heat exchanger 4 being formed so as to project downward. The communication portion 8 communicating an upper portion of the inner flue 7 and that of the outer flue 9 with each other is formed between the heat insulating member 72 and heat insulating wall 3. Namely, the inner flue 7, communication portion 8 and outer flue 9 are formed in the shape of an inverted "U" with the heat insulating wall 3 disposed there among as shown in FIG. 3, and the communication portion 8 corresponding to a bent part of the bent, inverted "U"-shaped structure is formed so that an upper portion thereof is covered with the heat insulating member 72. In an upper wall of the communication portion 8, a proportional thermostat 73 for detecting a temperature in the communication portion 8 is inserted so that a free end portion thereof projects into the interior of the communication portion 8.

As shown in FIG. 4, the exhaust cylinder 6 is formed into a substantially rectangular parallelopipedal shape, and stands up so as to contact a rear surface of the upper portion 11*a* of the casing. A lower portion of the exhaust cylinder 6 communicates as mentioned above with the outer flue 9 via the exhaust cylinder connecting port 13. The exhaust cylinder 6 is provided with an air intake port 61 at a bottom portion thereof, and an exhaust port 62 at an upper portion thereof. In a lower portion of the exhaust cylinder connecting port 13, an exhaust thermostat 63 for detecting an outlet temperature of the outer flue 9 is inserted so as to project at a free end portion thereof into the interior of the exhaust cylinder connecting port 13.

Above the exhaust cylinder 6, the tank 44 supported on a support member 45 is provided as shown in FIG. 1. The tank 44 is provided with a feed water port 46, and the hot water falling pipe 42 and hot water rising pipe 43 are connected to the tank 44. The hot water falling pipe 42 has a thermostat 48 fixed thereto for detecting a temperature of the hot water, and the hot water rising pipe 43 is provided with a hot water takeout port 47.

The operation of the waste incineration machine 1 formed as mentioned above will now be described.

The openable cover 12 is opened, and garbage, for example, leftover meat, is thrown into the combustion furnace 2. The cover 12 is then closed, and the main burners 51 are ignited to start the combustion of the garbage. During this time, the blower 27 is not operated, and the blast damper 29 and shutter 83 are left closed so that the outside air does not enter the combustion furnace 2. The main burners 51 heat the combustion chamber 5 to about 1,300° C. and heat the combustion furnace 2 and heat insulating wall 3. Consequently, the far infrared ray radiator 32 of the heat insulating wall 3 radiates far infrared rays toward the combustion furnace 2 to heat the same, so that the combustion furnace 2 can be efficiently heated. A combustion gas occurring in the combustion chamber 5 is discharged from the exhaust cylinder 6 to the outside via the inner flue 7, communication portion 8 and outer flue 9.

Since the outside air does not enter the combustion furnace, the garbage is placed in a smoked condition at a temperature of not higher than 800° C. A waste gas discharged during this time is sent out from the waste gas discharge ports 21 to the communication portion 8. In the communication portion 8, the waste gas is heated with the far infrared rays radiated from the upper portion of the heat insulating wall 3 and the heat insulating member 72, and a high-temperature combustion gas from the combustion chamber 5. Since the communication portion 8 is closed at an upper side thereof with a downdraft formed therein as will be described later, it is hard for the heat to escape. Therefore, the waste gas is heated to about 800° C., and the smoke and odor are decomposed to render the waste gas smokeless and odorless.

The waste gas flows from the communication portion 8 into the outer flue 9, and convects in the outer flue 9. Especially, a waste gas from the garbage contains a large quantity of vapor, and the volume of the waste gas increases while it is heated in the communication portion 8. Since the combustion furnace 2 is formed into a substantially cylindrical shape with the heat exchanger 4 formed into a rectangular box-shape open at the top and the bottom, the volume of the outer flue 9 is large. Accordingly, the waste gas does not pass speedily through the outer flue 9, i.e., the time of convection of the waste gas can be lengthened. In the outer flue 9, the waste gas receives the radiation of far infrared rays from the heat insulating wall 3, so that the remaining smoke and odor are eliminated therefrom, and the waste gas is subjected to heat exchange in the heat exchanger 4 and thereby cooled. Thus, the heat of the waste gas is removed gradually, and the volume thereof decreases, the waste gas being guided downward. During this time, the time of convection of the waste gas is long, so that the heat exchange rate increases. This enables high-temperature hot water to be obtained, and the temperature of the waste gas to be lowered.

Since the heat exchanger 4 is provided so as to surround the outer flue 9, an increase in the ambient temperature of the waste incineration machine 1 can be prevented.

Since a downwardly moving air flow (downdraft) is formed, it become difficult for the heat in the communication portion 8 to escape, and, owing to a conjoined effect of the low speed of passage of the waste gas through the communication portion 8, the waste gas can be heated sufficiently therein and rendered smokeless and odorless.

In the exhaust cylinder connecting port 13, an outlet of the outer flue 9, the waste gas reaches about 250° C., and flows into the exhaust cylinder 6. In the exhaust cylinder 6, the waste gas is diluted with the outside air entering the air intake port 61, and flows up as the temperature thereof decreases, the waste gas being then discharged from the exhaust port 62 to the outside. During this time, the temperature of the waste gas becomes as low as about 190° C., so that the discharging of a high-temperature waste gas can be prevented.

When the combustion of the garbage by the main burners 51 is continuously carried out with the temperature thereof becoming not lower than 800° C., the garbage in the combustion furnace 2 is carbonized. At this time, the gas is stopped to turn off the flames of the main burners 51, and the blower 27 is operated with the blast damper 29 and shutter 83 opened to blow out the air from the air blowout port 23 into the interior of the combustion furnace 2. Consequently, the carbonized garbage is burnt by itself and is turned into ashes, a part of which falls from the ash falling port 26*a* onto the lower ash receiving dish 28. Since the combustion temperature during this time is not lower than 800° C., the waste gas becomes smokeless and odorless. When the air is blown onto the garbage smoked, dried and carbonized so as to completely burn the garbage, the quantity of ashes can be reduced. Sine the garbage is made to burn by itself, fuel gas can be saved.

When the pressure in the incineration machine increases abnormally during the combustion of garbage, the dampers 16 normally closed are opened to enable pressure waves to escape to the outside.

Although the waste gas discharge ports 21 face the communication portion 8 in this mode of embodiment, they may also be provided so as to face the inner flue 7. In this case, the waste gas is also heated in the inner flue 7 and rendered smokeless and odorless. In short, the waste gas discharge ports 21 may be formed so that the waste gas from the combustion furnace 2 flows into the outer flue 9 through the communication portion 8.

The waste incineration machine according to the present invention is not limited to the above-described structure. For example, even when the insulating wall 3 is formed not into a substantially cylindrical shape but rather into a rectangular box-shape open at the top and the bottom, the volume of the outer flue 9 serving as a waste gas convection chamber increases, and the above-mentioned effects can be obtained. Namely, the construction of this waste incineration machine can be varied freely within the scope of the claims.

The waste incineration machine according to the present invention has the combustion furnace, the combustion chamber provided under the combustion furnace, the first far infrared ray radiator provided so as to surround the combustion furnace and combustion chamber, the heat exchanger provided so as to surround the first far infrared ray radiator, the inner flue formed between the first far infrared ray radiator and combustion furnace, the outer flue formed between the first far infrared ray radiator and heat exchanger and communicating with the inner flue, the second far infrared ray radiator provided above the communication portion between the inner and outer flues, and waste gas discharge ports provided in the combustion furnace so as to face the communication portion or inner flue. Therefore, the combustion furnace can be heated efficiently, and a waste gas can be rendered smokeless and odorless without providing an after-burner. It is also possible to reduce the temperature of a waste gas, obtain hot water, and hold down an increase in the ambient temperature of the combustion furnace. Accordingly, this waste incineration machine is suited for use as a small-sized waste incineration machine.

The first far infrared ray radiator is formed into a substantially cylindrical shape, and the heat exchanger into a rectangular box-shape open at the top and the bottom. Therefore, the volume of the outer flue through which the waste gas is circulated by convection can be increased, so that the time of convection of the waste gas can be lengthened. This enables a promotion of the removal of smoke and odor from the waste gas, promoted, the temperature of the waste gas to be reduced, and hot water of a higher temperature to be obtained.

The ventilating ports are formed at a lower portion of the outer flue with dampers provided therein; this enables pressure waves to escape to the outside when an abnormal pressure occurs.

The combustion furnace is provided with the air blowout port, to which the blower is connected via the blast pipe, and the openable shutoff member is provided in the blast pipe so that the air does not enter the air blowout port. Therefore, the waste smoked and then carbonized can be burnt by itself. This enables the saving of fuel, and a reduction the amount of ashes.

What is claimed is:

1. A waste incineration machine comprising:

a combustion furnace, a combustion chamber provided under said combustion furnace, a first far infrared ray radiator provided so as to surround said combustion furnace and said combustion chamber, a heat exchanger provided so as to surround said first far infrared ray radiator, an inner flue formed between said first far infrared ray radiator and said combustion furnace, an outer flue formed between said first far infrared ray radiator and said heat exchanger and communicating with said inner flue, a second far infrared ray radiator provided above a communication portion between said inner flue and said outer flue, and waste gas discharge ports provided in said combustion furnace so as to face said communication portion or said inner flue.

2. The waste incineration machine according to claim 1, wherein said first far infrared ray radiator is formed into a substantially cylindrical shape, and said heat exchanger formed within two concentric rectangular bodies open at a top and bottom.

3. The waste incineration machine according to claim 1, wherein said outer flue is provided at a lower portion thereof with ventilating ports, and with dampers being provided in said ventilating ports.

4. The waste incineration machine according to claim 1, wherein said combustion furnace is provided with an air blowout port, to which a blower is connected via a blast pipe, said blast pipe being provided with an openable shutoff member so that air does not enter said air blowout port.

* * * * *